US005256207A

United States Patent [19]

Sommer

[11] Patent Number: 5,256,207

[45] Date of Patent: Oct. 26, 1993

[54] PROCESS FOR CLEANING A SWIMMING POOL

[75] Inventor: Peter Sommer, Villnachern, Switzerland

[73] Assignee: 3S Systemtechnik AG, Remigen, Switzerland

[21] Appl. No.: 784,931

[22] Filed: Oct. 31, 1991

[30] Foreign Application Priority Data

Oct. 31, 1990 [CH] Switzerland ..... 03470/90
Oct. 16, 1991 [CH] Switzerland ..... 03032/91

[51] Int. Cl.[5] ..... B08B 7/00; B08B 7/04; B08B 9/00; E04H 4/16

[52] U.S. Cl. ..... 134/18; 134/42; 15/1.7

[58] Field of Search ..... 134/18, 42; 15/1.7

[56] References Cited

U.S. PATENT DOCUMENTS 3,439,368 4/1969 Myers ..... 15/1.7
4,692,956 9/1987 Kassis ..... 15/1.7

FOREIGN PATENT DOCUMENTS 0257006 2/1988 European Pat. Off. .
3110203 9/1982 Fed. Rep. of Germany .

*Primary Examiner*—Theodore Morris
*Assistant Examiner*—Zeinab El-Arini
*Attorney, Agent, or Firm*—Egli International

[57] ABSTRACT

The invention relates to a process and apparatus for cleaning a swimming pool, where the apparatus or device, moves back and forth in the swimming pool, and where the device has driving gears or belts that can be switched to drive reverse or forward during operation. A contact rail is frontally positioned in the cleaning casing of the device, and a swich rail is positioned at the rear of the casing. Correction-dependent signals are obtained by the device striking an obstacle and these signals are supplied to a gear via a control mechanism. Upon obtaining such signals, the driving gear or belt slows down and remains still for so long until the other driving gear or belt which is still moving turns the cleaning device around and until the rear switch rail is activated. The signals resulting from the switch rail are used for switching the gear to reverse and for straightening out the cleaning device to a new position and prepare it to a forwards motion to continue its course along the swimming pool.

8 Claims, 2 Drawing Sheets

PROCESS FOR CLEANING A SWIMMING POOL

BACKGROUND OF THE INVENTION

The invention relates to a process and apparatus for cleaning a swimming pool, where the apparatus, device, moves back and forth in the swimming pool, and where the device has a gear that can be switched between reverse and forward with driving gears or belt drives during operation; with a contact rail frontally positioned by the cleaning device's casing, as well as a rear positioned switch rail, where correction-dependent signals are supplied to the gear when the device is striking an obstacle via a control mechanism.

A process for driving a back- and forth-moving device to clean a swimming pool is known from the DE-A 3 110 203 which is provided with contact elements positioned somewhat in the direction of motion, by which the integrated drive motor stops at the started contact element when making contact with the swimming pool wall, whereby the device turns at an angle, which essentially refers to the longitudinal axis of the device and, thus, reverses the gear's direction of motion. With this device, the swimming pool will be cleaned in such a zigzag pattern that the corresponding wedge shaped stripes will not be cleaned.

DESCRIPTION OF RELATED REFERENCES

A process to clean a swimming pool by using an underwater immersible cleaning device is known from the EP-A 0 099 489 which executes a reversal in the direction of motion when contact is made with a wall or another obstacle, whereby the device is correspondingly controlled by a course regulator to adhere to a certain travel pattern path and alteration of the same.

According to a different process (EP-A 0 257 006), the device moves along a straight travel pattern path against a wall, whereby the device executes a half of a reversal and simultaneously shifts to the beginning in the exit direction and afterwards moves to the opposite wall. This device works with travel pattern paths positioned parallel to each other and moves from one wall to the other for so long until a desired floor section or even the entire floor section is cleaned.

With the known processes and devices for executing the process, the problem exists that the device is steered into an uncontrollable change in direction because of possible obstacles, for example, step ladders, steps, lamps, jets, etc. and/or by transitions, various pool levels, etc., whereby an optimal cleaning of the bottom of the pool is not, or at least not satisfactorily, guaranteed.

SUMMARY OF INVENTION

The present invention relates to the concept of the self- activating systematic cleaning of swimming pools, whereby it is the object of the invention to provide a process as well as a device for the execution of the process by using such directional changes of the device and, thus, using the resulting values to determine a correction in direction.

This objective is accomplished according to the process of the invention in that when activating the frontal contact rail, the one driving gear or belt slows down and remains still for so long until the other driving gear or belt still moving turns the cleaning device until it activates the rear switch rail on the level. The signals resulting from the switch rail are used for switching the gear to reverse and for straightening out the cleaning device by the obstacle and pulling it closer from straightening out the dependent signals for a following switch of the device to a parallel positioned forwards motion to the existing course or to the side pool wall.

In the combination of the following process steps, it can be detected that a preferred work process which is identified by the fact that momentary direction of motion in reference to the line of travel or the travel stripe is seized by an optical/electronic sensor during the travel movement of the cleaning device and the thereby resulting deviations are changed into signals and called up for the correction of the direction of motion; and that by activating the frontal contact rail, the cleaning device is turned until it activates the rear switch rail on the level and uses the thereby resulting signals for switching the gear to reverse, as well as straightening out the cleaning device by the obstacle, and also calling up the signals from straightening out for a shift of the gear to the forward gear.

According to the invention, to execute the work process, the cleaning device encompasses a gear capable of shifting back and forth between forwards and reverse, and is equipped with driving gears or belts, a contact rail positioned in the front of a casing of the cleaning device, as well as a switch rail positioned at the rear from which, correction dependent signals supply the gear via a control mechanism when the device moves into an obstacle, and is identified by the fact that the driving gears positioned on a drive shaft under the insertion of at least one clutch is connected via a transmission with a prime mover and the clutch with the control mechanism.

Further objectives of the invention are accomplished and shown in the following description of the figures and the individual patent claims.

BRIEF DESCRIPTION OF THE DRAWINGS

Hereinafter, the invention will be described with reference to the figures. What is shown is.

DETAILED DESCRIPTION OF THE PREFERRED EMBODIMENTS

Figure 1:
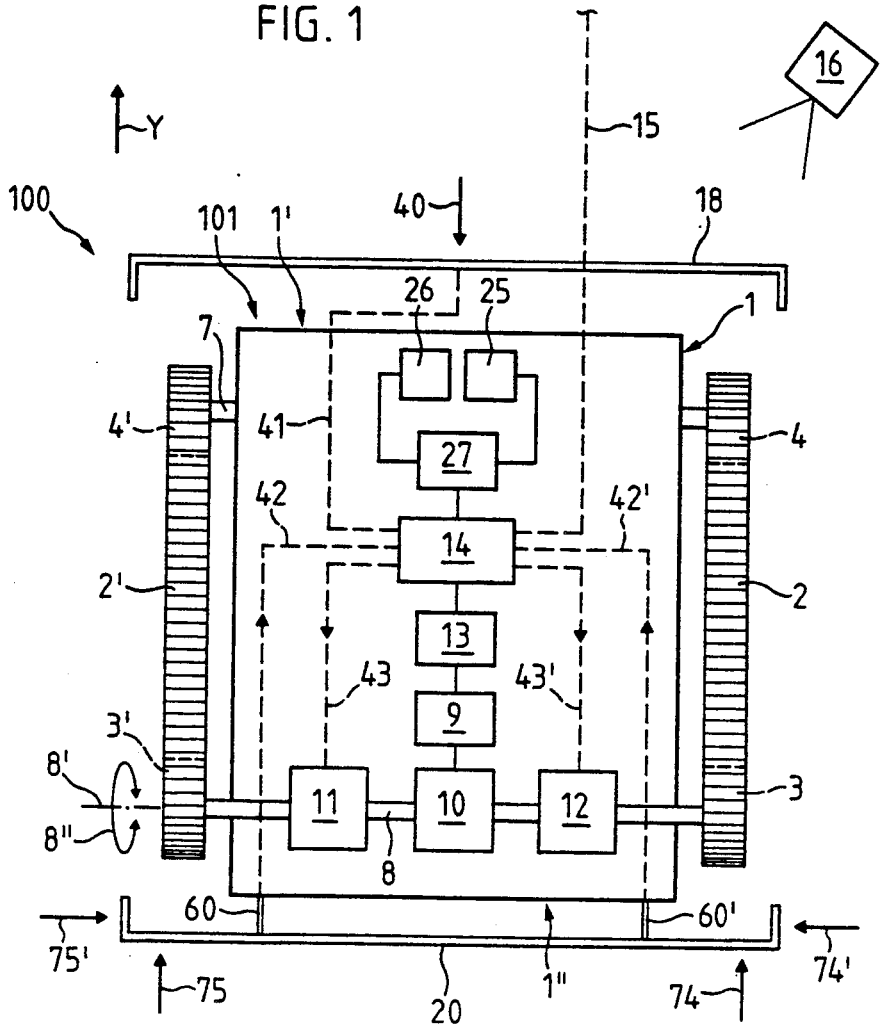
FIG. 1 a schematic plan representing a swimming pool cleaning device.

The cleaning device 100 has a schematically shown casing 1 which is provided with a suction front built to suck in liquid, as well as accepting dirt, shown in its entirety 101. At least one correspondingly stored, not shown, cleaning brush, as well as an integrated filter device is provided at the suction front 101 which is positioned in the travel direction Y and, essentially, the constructed front side 1' of casing 1. Furthermore, it can be recognize that a contact rail 18 in FIG. 1 on the front side 1' of casing 1 in a manner not further shown, as well as a switch rail 20 fastened to the back 1'' of casing 1. The function of the contact rail 18 and the switch rail 20 will be described individually later on.

A drive shaft 8 is provided for driving the cleaning device 100 in the direction Y which is stored in the casing 1 in a manner not further shown. The drive shaft 8 works in conjunction with a transmission 10 positioned within casing 1 under insertion in casing 1 of the positioned clutches 11 and 12. Both clutches 11 and 12 are built as electro or magnetic clutches. The correspondingly constructed driving gears 3 and 3' are positioned around their longitudinal axis 8 in the direction 8''.

The shaft 7 working in conjunction with impellers 4 and 4' is positioned at an axially parallel distance to the drive shaft 8 and is stored in the casing 1. The impellers 3, 3' and 4, 4' positioned by the drive shaft 8, as well as by the shaft 7, work in conjunction with each other via an endless drive belt 2, 2' built like a tractor, for example. Even more present, yet not shown any further, return- or driving gears can be positioned with the drive belt 2, 2' working together between the driving gears 3, 3' and the impellers 4, 4'.

A prime mover 9 is preferably positioned by an existing transmission 10 with a reduction-transmission stage, which is built as a three phase circuit-induction motor, for example, and is supplied with a modulated three phase circuit. Herewith, a constant number of revolutions on the drive shaft 8 is transmitted via the transmission 10 independent of the type of current and current frequency.

A static frequency changer 13 is connected to the prime mover 9, in which the one-phase-voltage is rectified via a cable 15 of a steering control 14 and, thus, a three-phase-alternating voltage with stable outlet frequency is created by an electronic switch (not shown) provided with power transistors. Thus, a corresponding switching of the prime mover 9 from forward to reverse can be achieved by using the steering control 14 which is connected to both clutches 11 and 12 by the lines 43 and 43'.

At this point, we would like to mention the fact that the drive belts 2, 2', the driving gears 3, 3' working in conjunction together with the drive shaft 8, the impellers 4, 4' working in conjunction together with the shaft 7, the transmission 10 with both clutches 11, 12, as well as the prime mover 9, together build on a forward-reverse switchable gear, not further described.

The electrical supply of the cleaning device 100 essentially occurs via the cable 15 in connection with the steering control 14 which is connected to an outlet (not shown) positioned outside of the swimming pool. The cable 15 is connected farther away by a corresponding waterproof service plug (not shown) with the casing 1, connected but separate.

A disconnecting transformer, which is not shown, is positioned between the network connection (outlet) and the cable 15 by using whichever existing network voltage over 50 volts is transformed onto a corresponding value, so that the insertion of the cleaning device 100 can also occur while people are swimming. The transformed value of the one-phase-voltage lies in the general vicinity of 42 volts.

Normally, the cleaning device 100 functions in the automatic mode by using the autopilot-control specifically designed for it. One can also use a remote control in a corresponding control box 16 to steer the cleaning device 100. For this reason, the cable 15 is preferably provided with a line, which is not shown, as the receiving antenna.

More optical/electrical sensors 25 and 26, as well as a plotting unit 27, are located in the casing 1 of the cleaning device 100. The plotting unit 27 supplies corresponding signals of the steering control 14.

At this point, it should be mentioned that in the place of the optical/electrical sensors 25, 26 an electronic course sensor-system, not shown any further, can be used and built into the casing 1 of the cleaning device 100.

Figure 3:
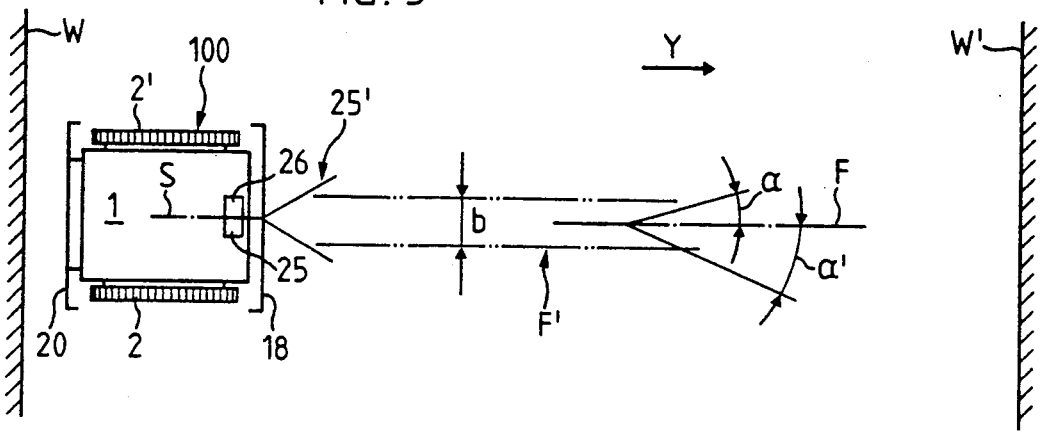
FIG. 3 a schematically represented travel pattern of a cleaning device.

As is schematically shown in FIG. 3, the relative position of the cleaning device 100 in reference to a fictitious line of travel F or rather in reference to a fictitious travel stripe F' oriented in the direction Y is measured with the first sensor 25 during the direction of motion of the cleaning device 100 oriented in the direction Y. Preferably, the relative position of the casing-symmetric axis S is measured in reference to the line of travel F or in reference to the travel stripe F'.

The width b of the travel stripe F' essentially corresponds to the permissible course variation within which the cleaning device 100 is allowed to move. The width b of the travel stripe F', however, can also correspond to the sphere of action of the sensor-beam 25' or the beam 25' of the width b is correspondingly laid out.

The resulting tolerance of the prescribed direction during the travel movement of the cleaning device 100 from the one wall W to the other wall W' (FIG. 3) is determined in the form of a horizontal skew notch under an angle a or a' in the side and is supplied as a corresponding signal from the first sensor 25 of the plotting unit 27. A comparison of the prescribed direction of movement with the momentary direction of movement (NOMINAL-TRUE VALUE comparison) is carried through in the plotting unit 27. A signal dependent on the comparison of the steering control 14 is supplied for a necessary correction of the direction of motion from the plotting unit 27, whereby the one or the other clutch 11 or 12, and thereby the integrated driving gear 3 or 3', is correspondingly activated. The correction referring to the horizontal skew notch of the direction of motion preferably occurs under inclusion and, thus, in dependence on the prescribed travel speed of the cleaning device 100.

With the second sensor 26, a possible ascent during the travel movement or even a grade in the swimming pool can be recognized and a corresponding switching signal of the plotting unit 27 can be supplied. This signal essentially causes a "STOP", that is, a change in direction (turning step) of the cleaning device 100 oriented in the level. With this change in direction, a sudden fall of the cleaning device 100 into a deeper part of the swimming pool or stalling when faced with an insurmountable ascent could be avoided.

As already mentioned, the contact rail 18 is positioned at the front side 101 of the casing 1 and is fastened by means not shown. As represented by the direction 40 in FIG. 1, a corresponding signal is given to the steering control 14 when striking the cleaning device 100 onto the one pool wall W or the other pool wall W' (FIG. 3); that is, onto an obstacle not shown via a line 41, from which the corresponding clutch 11 or 12 is activated via the lines 43, 43' and the integrated driving gear 3 or 3' is slowed down to include a turning- or swerving process, for example.

The switch rail 20 is positioned at the back 1'' of the casing 1 and is stored accordingly. Corresponding switch elements 60 and 60' are activated during the turning process while striking the switch rail 20 onto the pool wall W or W'. Activating the switch elements 60, 60' occurs in dependence on the relative position of the cleaning device 100 in reference to the pool wall W or W' (FIG. 3). The switch elements 60, 60' are activated corresponding to the relative position of the cleaning device 100 to the pool wall W or W' in accordance with the direction 74, 74' and 75, 75', whereby corresponding signals dependent on the angle location of the steering control 14 are supplied via lines 42, 42'.

Figure 2:
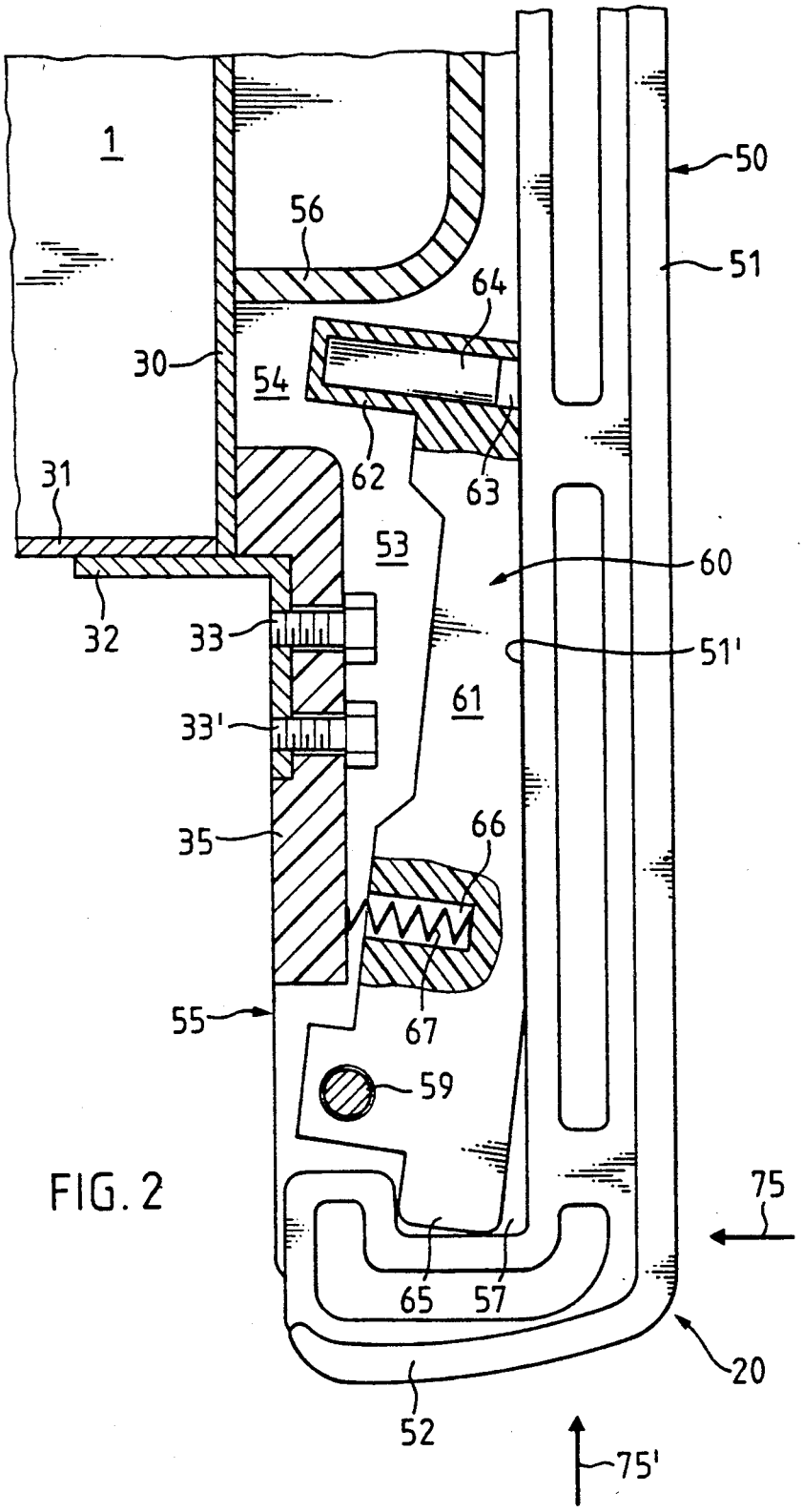
FIG. 2 a part of a switch guide rail for the cleaning device at a larger scale and partly in cross-section according to FIG. 1.

FIG. 2 indicates a part of the switch rail marked by 20 in its entirety represented by a partial cross-section and on a larger scale. You can recognize the casing 1 with the back wall 30, as well as the side wall 31, to the intake of the switch rail 20.

The switch rail 20 encompasses a carrier element 50, partly built like a hollow body and positioned at a carrier plate in a manner not shown any further and with a bumper rail 51, as well as with a shaped side piece 52. The carrier element 50 with a main chamber 53, as well as a side chamber 54 for the therein stored switch element 60, is supported by a wall part 56 at the rear wall 30 of the casing 1. Furthermore, the carrier element 50 is fastened to an angle piece 32 with a bracket 35 positioned by the carrier plate 55 by using screws 33, 33'. The angle piece 32 positioned at the side wall 31 of the casing 1 is fastened to the side wall 31 in a manner not shown.

The switch element 60 positioned in the main chamber 53 of the carrier element 50 encompasses a lever piece 61 swivel-mounted around a bolt 59 which is essentially supported on the inner side 51' of the bumper rail 51. At the one end of the lever piece 61 is the first head piece 62 and at the other end a second head piece 65 is formed. In the first head piece 62 an intake 63 is provided, which is constructed to attract a permanent magnet 64. The second head piece 65 is positioned in an intake 57 of the carrier element side piece 52 limited by the swivel movement of the switch elements 60. The lever piece 61 is, furthermore, provided with an intake 66, in which a spring element 67 is positioned at a bracket 35.

At this point, it should be mentioned that the other part of the carrier element 50, not shown, with the switch element 60' (FIG. 1) positioned therein and the individual parts analogous to the described part in connection with FIG. 2, is developed and will therefore not be described any further.

The functioning manner of the described cleaning device will be described in the following:

To begin, place the cleaning device 100 on the bottom of the swimming pool to be cleaned and turn the power on, so that the cleaning device moves in the direction Y, as schematically represented in FIG. 1 or FIG. 3. One can use the remote control via the control box 16 to move the cleaning device. As soon as the cleaning device touches the pool wall with the contact rail 18, a signal is sent to the control mechanism 14, which activates the clutch 11 or 12 and slows down or stops the driving gear 3' or 3 with the drive belt 2' or 2. Simultaneously, the control mechanism 14 shifts the gear 9 to reverse via the static frequency changer 13, whereby the cleaning device 100 turns around a fictitious device axis for so long until the switch rail 20 slams against the pool wall and thus, activates the corresponding switch element 60 or 60'. Herewith, again, we achieve a switching of the prime mover 9, so that the cleaning device 100 can run and clean a neighboring course.

An optical/electronic sensor 25 measures a fictitious line of travel F or a travel stripe F' during the run, as schematically represented in FIG. 3 in a preferred example, and thus, compares the momentary direction of motion with the given direction of motion and corrects it accordingly.

To attain an optimal align-movement of the cleaning device 100 to the integrated pool wall, the shifting of the clutches 11 and 12 occurs for so long, until the corresponding signals from the switch elements 60, 60' reach the steering control 14 and thus, the parallelism to the pool wall is indicated. Aligning the cleaning device 100 is made optimal by the signals from the side in the direction 74, 74' and 75, 75'.

With swimming pools of unusual shapes, for example a so-called kidney shaped pool or the similar, or with swimming pools with various positioned obstacles, the turning angle is measured during the shifting process. Thus, the resting clutch is turned off after achieving a rotation movement of 180°. The cleaning device 100 is set so far back until the switch rail 20 signals wall contact.

If, however, after the reverse signal, the measured turning angle is not completed by 180° (signal: turning process not terminated), then the corresponding difference to the nominal angle of 180° is completed in such a manner that a switching of the prime mover 9 is carried out by activating the corresponding clutch 11 or 12.

The turning process of the cleaning device 100 can also be achieved by a forward rotation of 180° by using the sensor 26 during the forward motion and when recognizing an obstacle. This is how the corresponding rotation angle is measured by using the sensor.

I claim:

1. A process for cleaning a swimming pool floor, comprising the steps of: moving a cleaning device back and forth over the floor whereby the device has a steering control connected to at least two driving gears or belts moving the device in one direction but which driving gears are reversible from forward to a backward motion; correcting movement of the device by generating direction-correction signals through making contacts between one of a contact rail located on a front side of the device and a switch rail located on a back side of the device and an obstacle on the floor; sending a direction-correction signal upon making contact to a control mechanism of one driving gear and stopping the one gear, while the other driving gear is still moving, until the switch rail receives a direction-correction signal to reverse the direction causing the device to turn into a new direction; monitoring movement of travel of the device relative to a line of travel (F) or an instantaneous travel strip (F') with at least one sensor and converting any deviation into a direction-correction signal; and monitoring vertical movement of the device relative to the line of travel (F) with at least one sensor and converting any deviation from a travel plane into a correction signal to stop or turn the device.

2. The process of claim 1, wherein the direction-correction signal to the switch rail is only received when the device is parallel to the obstacle.

3. The process of claim 1, wherein a turning movement of the device is set at a nominal angle of 180° and the instantaneous turning movement is being monitored and determined by an orientation-sensoring system.

4. The process of claim 3, wherein an incomplete turning movement of the device is supplemented by the deviation from the nominal angle.

5. The process of claim 4, wherein the supplementation to the turning movement is accomplished by reversing a gear.

6. The process of claim 3, wherein the device after recognition of an obstacle during forward motion is turned by 180° and the thereby accomplished angle is detected by the direction sensor system.

7. The process of claim 1, wherein the deviations derived from the changes of the instantaneous directional movements are determined, under consideration of instantaneous travel speed, and are compared to the nominal travel speed and, after conversion, are utilized as directional correction signals.

8. The process of claim 1, wherein during the travel motion of the device, the spontaneous travel direction relative to the line of travel or travel stripe is controlled by a sensor and the thus determined deviations are converted into a signal and utilized as directional correction signals and further, wherein during utilizing the contact rail the device is turned until the switch rail kicks in and the signals thus created are utilized for the switching of the gears into reverse, and for orientation of the device relative to the obstacle and further for the switching over of the gears into forward forward direction.

* * * * *